US007800294B2

(12) United States Patent
Kang et al.

(10) Patent No.: US 7,800,294 B2
(45) Date of Patent: Sep. 21, 2010

(54) LIGHT EMISSION DEVICE AND DISPLAY DEVICE USING THE LIGHT EMISSION DEVICE AS LIGHT SOURCE

(75) Inventors: Su-Joung Kang, Yongin-si (KR); Kyung-Sun Ryu, Yongin-si (KR); Kyu-Won Jung, Yongin-si (KR); Jong-Hoon Shin, Yongin-si (KR); Pil-Goo Jun, Yongin-si (KR); Jin-Ho Lee, Yongin-si (KR); Sang-Jin Lee, Yongin-si (KR)

(73) Assignee: Samsung SDI Co., Ltd., Yongin (KR)

( * ) Notice: Subject to any disclaimer, the term of this patent is extended or adjusted under 35 U.S.C. 154(b) by 600 days.

(21) Appl. No.: 11/711,271

(22) Filed: Feb. 27, 2007

(65) Prior Publication Data

US 2008/0036360 A1 Feb. 14, 2008

(30) Foreign Application Priority Data

Aug. 14, 2006 (KR) ..... 10-2006-0076662

(51) Int. Cl.
*H01J 1/62* (2006.01)

(52) U.S. Cl. ..... 313/496; 313/310; 313/495

(58) Field of Classification Search ..... 313/310, 313/495–497

See application file for complete search history.

(56) References Cited

U.S. PATENT DOCUMENTS 5,504,387 A 4/1996 Hamagishi et al.
5,508,584 A 4/1996 Tsai et al.
5,606,225 A 2/1997 Levine et al.
5,646,702 A 7/1997 Akinwande et al.
5,779,920 A 7/1998 Chadha et al.
5,828,352 A 10/1998 Nomura et al.

(Continued)

FOREIGN PATENT DOCUMENTS

CN 1790604 A 6/2006

(Continued)

OTHER PUBLICATIONS

Partial European Search Report for European Application No. 07110162.0 dated Dec. 18, 2007.

(Continued)

*Primary Examiner*—Bumsuk Won
(74) *Attorney, Agent, or Firm*—Knobbe Martens Olson and Bear LLP

(57) ABSTRACT

A light emission device and a display device using the light emission device as the light source are disclosed. In one embodiment, the light emission device includes i) first and second substrates facing each other and forming a vacuum vessel, ii) an electron emission unit provided on the first substrate, and iii) a light emission unit provided on the second substrate. The light emission unit may include i) a transparent anode electrode formed on the second substrate, ii) a phosphor layer formed on the anode electrode, and iii) a plurality of sub-electrodes contacting the anode electrode and crossing the phosphor layer under the phosphor layer. The sub-electrodes may have a resistance lower than that of the anode electrode.

17 Claims, 5 Drawing Sheets

U.S. PATENT DOCUMENTS

| | | | | |
|---|---|---|---|---|
| 2002/0043924 | A1* | 4/2002 | Kato et al. | 313/496 |
| 2002/0125490 | A1* | 9/2002 | Chuman et al. | 257/93 |
| 2003/0025851 | A1* | 2/2003 | Cheng et al. | 349/61 |
| 2003/0122771 | A1 | 7/2003 | Sumiyoshi et al. | |
| 2005/0134169 | A1 | 6/2005 | Hwang | |
| 2005/0168129 | A1* | 8/2005 | Chi | 313/495 |
| 2005/0264221 | A1* | 12/2005 | Suzuki et al. | 315/160 |
| 2006/0138933 | A1 | 6/2006 | Yoo et al. | |
| 2007/0222354 | A1* | 9/2007 | Chen | 313/311 |

FOREIGN PATENT DOCUMENTS

| | | | |
|---|---|---|---|
| EP | 1 858 057 | A | 11/2007 |
| JP | 08-329867 | A | 12/1996 |
| JP | 63-264379 | | 11/1998 |
| JP | 11-317181 | | 11/1999 |
| KR | 1994-0015620 | | 7/1994 |
| KR | 10 2001 0058198 | A | 7/2001 |
| KR | 10 2005 0104651 | A | 11/2005 |
| KR | 10 2005 0113897 | A | 12/2005 |
| TW | 200418074 | | 9/2004 |
| TW | 1238432 | | 8/2005 |
| TW | 200608080 | | 3/2006 |
| TW | 200609342 | | 3/2006 |
| WO | WO 02/069030 | A | 9/2002 |

OTHER PUBLICATIONS

European Search Report for European Patent Application No. 07110162.0 by European Patent Office dated Aug. 14, 2008.

* cited by examiner

LIGHT EMISSION DEVICE AND DISPLAY DEVICE USING THE LIGHT EMISSION DEVICE AS LIGHT SOURCE

CROSS-REFERENCE TO RELATED APPLICATION

This application claims priority to and the benefit of Korean Patent Application No. 10-2006-76662 filed in the Korean Intellectual Property Office on Aug. 14, 2006, the entire content of which is incorporated herein by reference.

BACKGROUND OF THE INVENTION

1. Field of the Invention

The present invention relates to a light emission device which can be used as a light source for a display device.

2. Description of Related Art

A liquid crystal display device (LCD) is a non-self emissive display device. The LCD includes a liquid crystal (LC) panel assembly and a backlight unit for emitting light toward the LC panel assembly. The LC panel assembly receives light emitted from the backlight unit and selectively transmits or blocks the light using a liquid crystal layer.

The backlight unit is classified, according to a light source, into different types, one of which is a cold cathode fluorescent lamp (CCFL). The CCFL is a linear light source that can uniformly emit light to the LC panel assembly through a plurality of optical members such as a diffusion sheet, a diffuser plate, and/or a prism sheet.

However, since the CCFL emits the light through the optical members, there may be a light loss. In the CCFL type LCD, only 3-5% of light generated from the CCFL is transmitted through the LC panel assembly. Furthermore, since the CCFL has relatively higher power consumption, the overall power consumption of the LCD employing the CCFL increases. In addition, since the CCFL is difficult to be large-sized due to its structural limitation, it is hard to apply CCFL to a large-sized LCD over 30-inch.

A backlight unit employing light emission diodes (LEDs) is also well known. The LEDs are point light sources that are combined with a plurality of optical members such as a reflection sheet, a light guiding plate, a diffusion sheet, a diffuser plate, a prism sheet, and/or the like, thereby forming the backlight unit. The LED type backlight unit has fast response time and good color reproduction. However, the LED is costly and increases an overall thickness of the LCD.

The conventional backlight units are driven so as to maintain a predetermined brightness all over the light emission surface when the LCD is driven. Therefore, it is difficult to improve the display quality to a sufficient level.

For example, when the LC panel assembly intends to display an image having a high luminance portion and a low luminance portion in response to an image signal, it will be possible to realize an image having a more improved dynamic contrast if the backlight unit can emit lights having different intensities to pixels of the LC panel assembly displaying the high and low luminance portions.

However, the conventional backlight units cannot achieve the above function and thus there is a limitation in improving the dynamic contrast of the image displayed by the LCD.

SUMMARY OF CERTAIN INVENTIVE ASPECTS

One aspect of the present invention provides a light emission device that can uniformly emit light from the entire light emission surface and a display device using the light emission device as a backlight unit.

Another aspect of the present invention provides a light emission device that can independently control light intensities of a plurality of divided regions of a light emission surface and a display device that can enhance the dynamic contrast of the screen by using the light emission device as a backlight unit.

Another aspect of the present invention provides a light emission device including i) first and second substrates facing each other and forming a vacuum vessel, ii) an electron emission unit provided on the first substrate, and iii) a light emission unit provided on the second substrate. The light emission unit includes i) a transparent anode electrode formed on the second substrate, ii) a phosphor layer formed on the anode electrode, and iii) a plurality of first sub-electrodes contacting the anode electrode and crossing the phosphor layer under the phosphor layer. The first sub-electrodes have a resistance lower than that of the anode electrode.

The first sub-electrodes may be formed on the anode electrode and thinner than that of the phosphor layer which covers the first sub-electrodes. The first sub-electrodes may be formed of at least one of: Mo, Al, a Mo alloy, and an Al alloy.

Alternatively, the first sub-electrodes may be formed on the surface of the anode electrode and substantially similar or identical to the phosphor layer in thickness, wherein the phosphor layer may be formed between the first sub-electrodes. The first sub-electrodes may be formed of carbon-based conductive material.

The phosphor layer may be divided into a plurality of sections spaced apart from each other and the light emission device may further include a second sub-electrode formed between the sections of the phosphor layer. The second sub-electrode may have a width greater than that of the first sub-electrode.

The light emission unit may include a reflective layer formed on a surface of the phosphor layer facing the first substrate. The electron emission unit includes first and second electrodes insulated from each other and crossing each other and electron emission regions electrically connected to one of the first and second electrodes.

Another aspect of the present invention provides a display device including: i) a display panel for displaying an image and ii) a light emission device configured to provide light to the display panel. The light emission device includes i) first and second substrates facing each other and defining a space therebetween, ii) a light emission unit including a transparent anode electrode formed on the second substrate, a phosphor layer formed on the anode electrode, and a plurality of first sub-electrodes contacting the anode electrode.

The light emission device may include a plurality of pixels, the number of which is less than that of the pixels of the display panel, arranged in first and second directions substantially crossing each other. The light emission device may further comprise an electron emission unit located on the first substrate and including a plurality of scan electrodes arranged along one of the first and second direction and a plurality of data electrodes arranged along the other direction. The pixels of the light emission device may have light intensities controlled by the scan and data electrodes.

The thickness of at least one of the plurality of first sub-electrodes may be less than that of the phosphor layer, and the phosphor player may cover the at least one first sub-electrode. Alternatively, the thickness of at least one of the first sub-electrodes may be substantially similar to that of the phosphor layer. The at least two of the first-sub electrodes may differ in width.

The phosphor layer may include a plurality of sections spaced apart from each other, wherein the light emission device may further comprise a plurality of second sub-electrodes formed between the sections of the phosphor layer, and wherein at least one of the plurality of second sub-electrodes may have a width greater than that of the first sub-electrodes.

DETAILED DESCRIPTION OF CERTAIN INVENTIVE EMBODIMENTS

Figure 1:
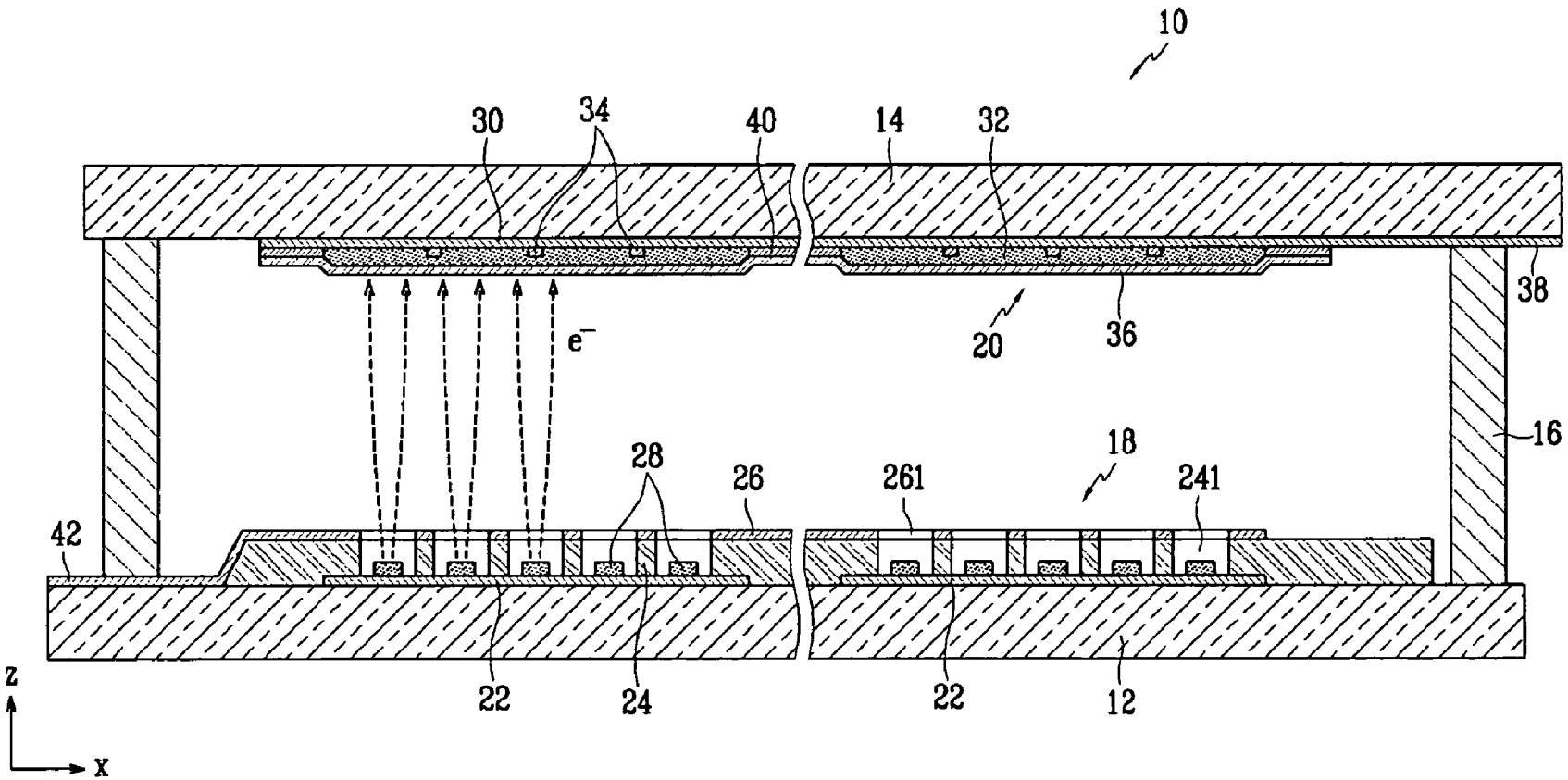
FIG. 1 is a sectional view of a light emission device according to an embodiment of the present invention.

Embodiments of the present invention will now be described more fully with reference to the accompanying drawings FIG. 1 is a sectional view of a light emission device 10 according to an embodiment of the present invention.

Referring to FIG. 1, the light emission device 10 includes first and second substrates 12 and 14 facing each other at a predetermined interval. A sealing member 16 is provided at the peripheries of the first and second substrates 12 and 14 to seal them together and thus form a sealed vessel. The interior of the sealed vessel is kept to a degree of vacuum of about $10^{-6}$ Torr.

Each of the first and second substrates 12 and 14 has an active area configured to emit visible light and an inactive area surrounding the active area. The inactive area does not emit light. The active area includes an electron emission unit 18 for emitting electrons located on the first substrate 12, and a light emission unit 20 for emitting the visible light located on the second substrate 14 as shown in FIG. 1. The visible light emits in a positive z-axis direction.

Figure 2:
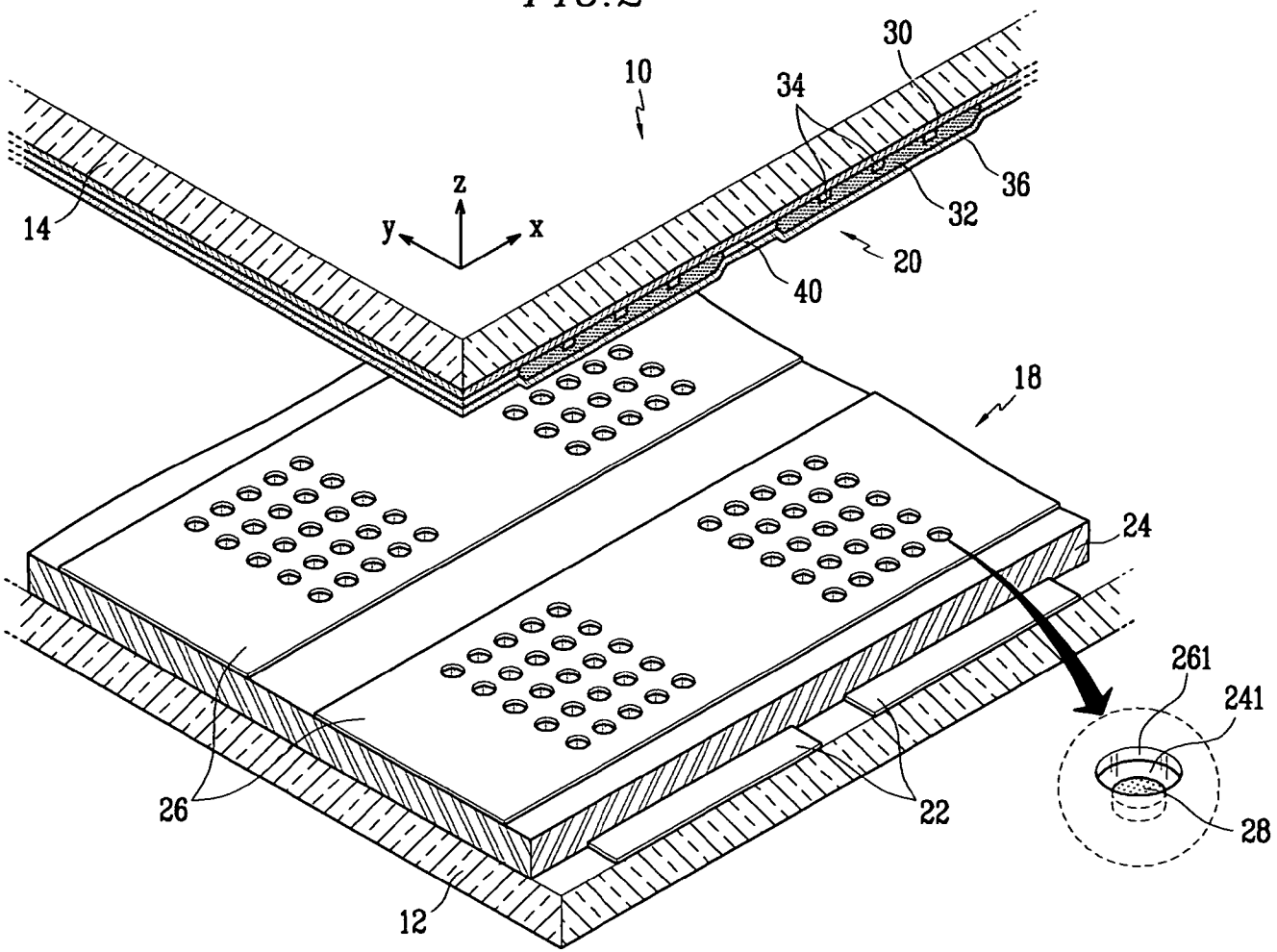
FIG. 2 is a partial exploded perspective view of an active area of the light emission device of FIG. 1.

FIG. 2 is a partial exploded perspective view of an active area of the light emission device of FIG. 1.

Referring to FIGS. 1 and 2, the electron emission unit 18 includes first electrodes 22, second electrodes 26, and electron emission regions 28. The first and second electrodes 22 and 26 are insulated from each other by an insulating layer 24. The electron emission regions 28 are electrically connected to the first electrodes 22. Alternatively, although not shown in FIG. 2, the electron emission regions 28 may be electrically connected to the second electrodes 26.

When the electron emission regions 28 are formed on the first electrodes 22, the first electrodes 22 are cathode electrodes applying a current to the electron emission regions 28 and the second electrodes 26 are gate electrodes inducing the electron emission by forming the electric field around the electrode emission regions 28 corresponding to a voltage difference between the cathode and gate electrodes. On the contrary, when the electron emission regions 28 are formed on the second electrodes 26, the second electrodes 26 are the cathode electrodes and the first electrodes 22 are the gate electrodes.

Among the first and second electrodes 22 and 26, the electrodes arranged along the x-axis direction function as scan electrodes and the electrodes arranged along the y-axis direction function as data electrodes.

In FIGS. 1 and 2, if the electron emission regions 28 are formed on the first electrodes 22, the first electrodes 22 are arranged along the columns (in y-axis direction in FIG. 2) of the light emission device 10, and the second electrodes 26 are arranged along the rows (in x-axis direction in FIGS. 1 and 2) of the light emission device 10 is illustrated. However, the arrangements of the electron emission regions 28 and the first and second electrodes 22 and 26 are not limited to the above examples.

Openings 241 and 261 are formed through the insulating layer 24 and the second electrodes 26, respectively, to partly expose the surface of the first electrodes 22 as shown in FIGS. 1 and 2. The electron emission regions 28 are formed on the first electrodes 22 through the openings 241 of the insulating layer 24.

The electron emission regions 28 are formed of a material emitting electrons when an electric field is applied thereto under a vacuum atmosphere, such as a carbonaceous material or a nanometer-sized material. The electron emission regions 28 can be formed of carbon nanotubes, graphite, graphite nanofibers, diamonds, diamond-like carbon, $C_{60}$, silicon nanowires or a combination thereof. The electron emission regions 28 can be formed through a screen-printing process, a direct growth, a chemical vapor deposition, or a sputtering process.

Alternatively, the electron emission regions can be formed in a tip structure formed of a Mo-based or Si-based material.

One crossed region (one of the four electron emission groups shown in FIG. 2) of the first and second electrodes 22 and 26 may correspond to one pixel region of the light emission device 10. Alternatively, two or more crossed regions of the first and second electrodes 22 and 26 may correspond to one pixel region of the light emission device 10. In this case, two or more first electrodes 22 and/or two or more second electrodes 26 that are placed in one pixel region are electrically connected to each other to receive a common driving voltage.

In one embodiment, the light emission unit 20 includes a transparent anode electrode 30 formed on the second substrate 14, a phosphor layer 32 formed on the anode electrode 30, a plurality of first sub-electrodes 34 contacting the anode electrode 30 and covered by the phosphor layer 32, and a reflective layer 36 formed on the phosphor layer 32. In one embodiment, the first sub-electrodes 34 are arranged in a predetermined pattern and have a relatively lower resistance compared to that of the anode electrode 30.

The anode electrode 30 is formed of a transparent conductive layer such as an indium tin oxide (ITO) layer to transmit the visible light emitted from the phosphor layer 32. A portion of the anode electrode 30 extends out of the sealing member 16 to form an anode lead 38 (see FIG. 1) for the voltage application.

The phosphor layer 32 may be a white phosphor layer that is formed on the entire active area of the second substrate 14 or divided into a plurality of sections arranged in a predetermined pattern and spaced apart from each other. In both of these cases, the first sub-electrodes 34 may be covered by the phosphor layer 32 and formed in a line pattern or a lattice pattern (see FIG. 3).

In one embodiment, the first sub-electrodes 34 are formed of a material having a resistance lower than that of the anode electrode 30. For example, the first sub-electrodes 34 may be formed of at least one of Mo, Al, a Mo alloy, and an Al alloy. The first sub-electrodes 34 may be formed on the anode electrode 30 before the phosphor layer 32 is formed. At this point, the thickness of the first sub-electrode 34 is about thousands Å. The thickness of the phosphor layer 32 may be several μm. The phosphor layer 32 is formed on the anode electrode 30 while covering the first sub-electrodes 34.

In one embodiment, the width of the first sub-electrode 34 is sized such that the first sub-electrodes 34 are invisible from the outer surface of the second substrate 14 and do not significantly block the path of the visible light emitted from the phosphor layer 32. In one embodiment, the width of the first sub-electrode 34 is substantially equal to or less than about 20 μm. If the width of the first sub-electrode 34 is too short, the line resistance of the first sub-electrode 34 increases and it is difficult to perform the patterning process for the first sub-electrodes 34. In another embodiment, the width of the first sub-electrode 34 is substantially equal to or greater than about 5 μm.

In one embodiment, the first sub-electrodes 34 reduce the line resistance of the anode electrode 30 when an anode voltage is applied to the anode electrode 30 through the anode lead 38 and thus minimize the voltage difference between a portion of the anode electrode 30 close to the anode lead 38 and a portion of the anode electrode 30 far from the anode lead 38. In another embodiment, first sub-electrodes 34 provide substantially uniform voltage distribution on the entire surface of the anode electrode 30.

In a conventional light emission device without sub-electrodes, since the anode electrode made of ITO has a relatively high resistance, there is a voltage difference between a portion close to the anode lead and a portion far from the anode lead. The luminance of the light emission device is proportional to the anode voltage. Therefore, the luminance of the light emission device is not uniform throughout the entire light emission surface thereof due to the voltage difference.

The reflective layer 36 is formed of metal such as Al to enhance the luminance of the screen by reflecting the visible light, which is emitted from the phosphor layer 32 to the first substrate 12, toward the second substrate 14.

Spacers (not shown) are disposed between the first and second substrates 12 and 14 in order to uniformly maintain a gap between the first and second substrates 12 and 14 against an external force.

Figure 3:
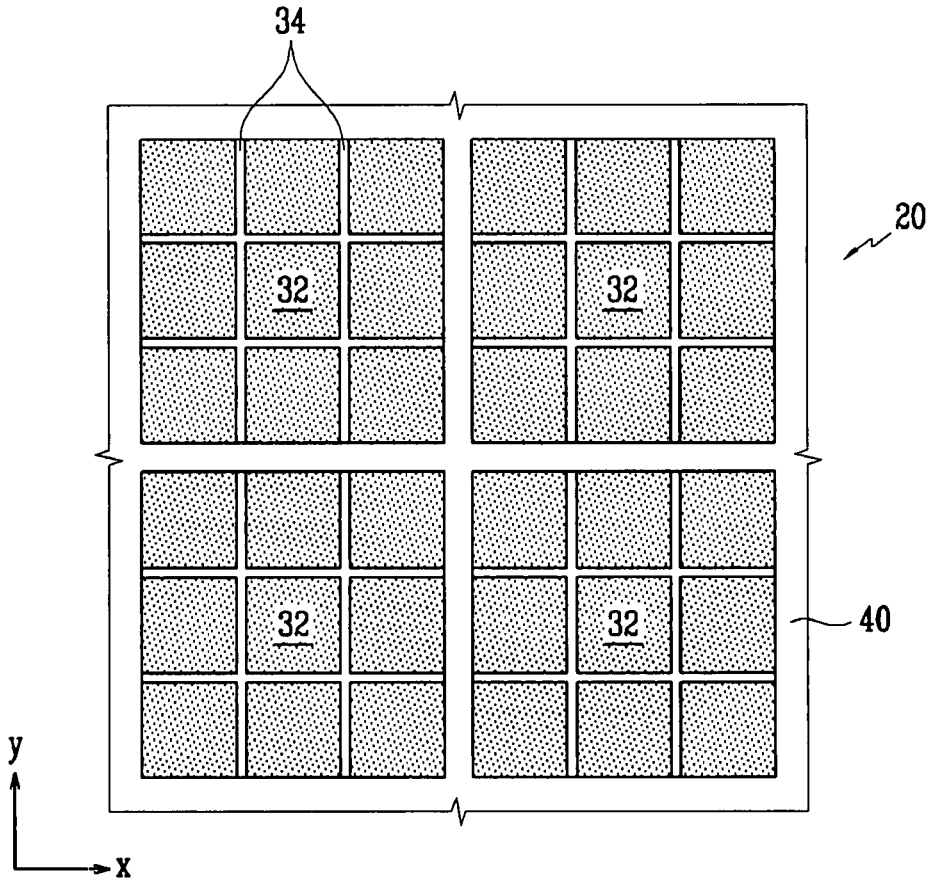
FIG. 3 is a partial enlarged top view of a light emission unit of the light emission device of FIG. 1.

As illustrated in FIG. 3, when the phosphor layer 32 is divided into the plurality of sections, one or more sections may correspond to one pixel region. Alternatively, one section may correspond to two or more pixel regions. In at least one embodiment, each section of the phosphor layer 32 may be formed in a rectangular shape as shown in FIG. 3. A second sub-electrode 40 may be formed in a lattice pattern between the sections of the phosphor layers 32.

In one embodiment, the second sub-electrode 40 is formed of a material having a resistance lower than that of the anode electrode 30. The width of the second sub-electrode 40 is greater than that of the first sub-electrode 34. The second sub-electrode 40 may be formed of substantially the same conductive material as or a different conductive material from that of the first sub-electrodes 34. In the former case, the second sub-electrode 40 may be formed together with the first sub-electrodes using a single mask pattern.

Figure 4:
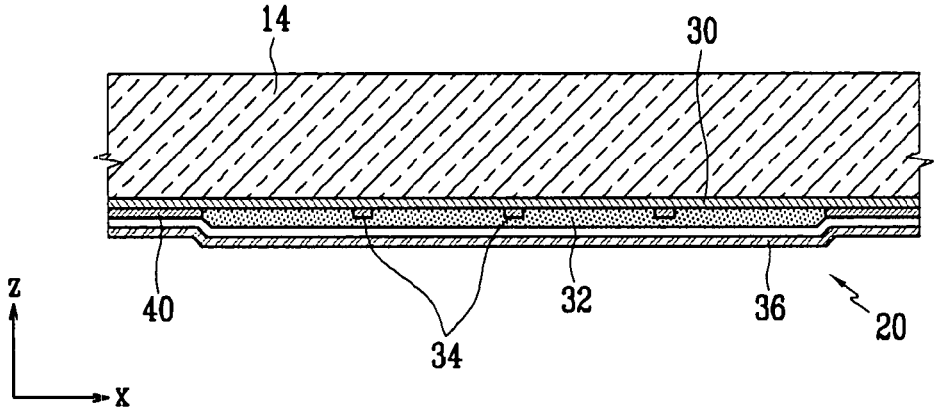
FIG. 4 is a partial enlarged sectional view of a light emission unit of the light emission device of FIG. 1.

In FIG. 4, the second sub-electrode 40 is formed of the same material as that of the first sub-electrodes 34 and simultaneously patterned together with the first sub-electrodes 34. The first and second sub-electrodes 34 and 40 may have a identical thickness.

A gap is formed between the reflective layer 36 and the phosphor layer 32 as follows. First, an interlayer (not shown) formed of a polymer material that can be decomposed at a high temperature is formed on the phosphor 32. Next, a material for forming the reflective layer 36 is deposited on the interlayer. Then, the interlayer is removed through a thermal process, thereby forming the fine gap. Since the phosphor layer 32 and the reflective layer 36 are supported by the spacer (not shown), the fine gap can be maintained. Therefore, the reflective layer 36 is not affected by a surface roughness of the phosphor layer 32 but is substantially planar.

The above-described light emission device 10 is driven by applying driving voltages to the first and second electrodes 22 and 26 and applying a positive DC voltage, for example thousands of volts, to the anode electrode 30. The reference number 42 in FIG. 1 denotes second electrode leads extending from the second electrodes 26.

Then, an electric field is formed around the electron emission regions 28 at pixel regions where a voltage difference between the first and second electrodes 22 and 26 is higher than a threshold value, thereby emitting electrons from the electron emission regions 28. The emitted electrons are accelerated by the high voltage applied to the anode electrode 30 to collide with a corresponding section of the phosphor layer 32, thereby exciting the corresponding section of the phosphor layer 32. A light emission intensity of the phosphor layer 34 at each pixel corresponds to an electron emission amount of the corresponding pixel.

In the above-described driving process, since the first and second sub-electrodes 34 and 40 lower the line resistance of the anode electrode 30, a voltage of a portion of the light emission unit 20, which is close to the anode lead 38, becomes substantially identical to that of a portion of the light emission unit 20, which is far from the anode lead 38. At this point, since the light emission intensity of the phosphor layer 32 is proportional to the anode voltage, the light emission device 10 of this embodiment can uniformly emit the light throughout the entire active area of the light emission unit 20.

Figure 5:
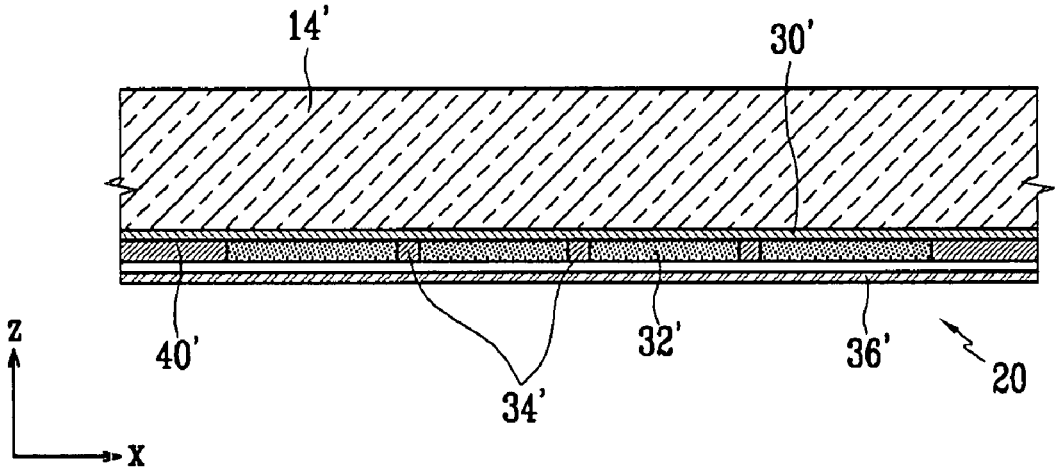
FIG. 5 is a partial enlarged sectional view of a second substrate and a light emission unit of a light emission device according to another embodiment of the present invention.

FIG. 5 is a partial enlarged sectional view of a second substrate and a light emission unit of a light emission device according to another embodiment of the present invention.

Referring to FIG. 5, a light emission unit 20' of this embodiment is identical to that of the foregoing embodiment except that the thickness of first sub-electrodes 34' is similar or identical to that of a phosphor layer 32' which is formed between the first sub-electrodes 34'.

That is, in this embodiment, the first sub-electrodes 34' is formed of a carbon-based material such as graphite through a thick filming process such as a screen-printing process to have the above-described height. The width of the first sub-electrode 34' is designed to be substantially identical to that of the first sub-electrode 34 described in the foregoing embodiment.

In addition, when the phosphor layer 32' is divided into a plurality of sections that are arranged in a predetermined pattern and spaced apart from each other, a second sub-electrode 40' may be formed between the sections of the phosphor layer 32'. The second sub-electrode 40' is formed of the same material as that of the first sub-electrodes 34'. Heights of the first and second sub-electrodes 34' and 40' may be similar or identical to each other.

In the above described at least one embodiment, the gap between the first and second substrates 12 and 14 may be, for example, about 5 mm to about 20 mm. The anode electrode 30 may receive a high voltage such as greater than about 10 kV, or about 10-15 kV, through the anode lead 38. Accordingly, in one embodiment, the light emission device 10 realizes a luminance above 10,000 cd/m$^2$ at a central portion of the active area.

Figure 6:
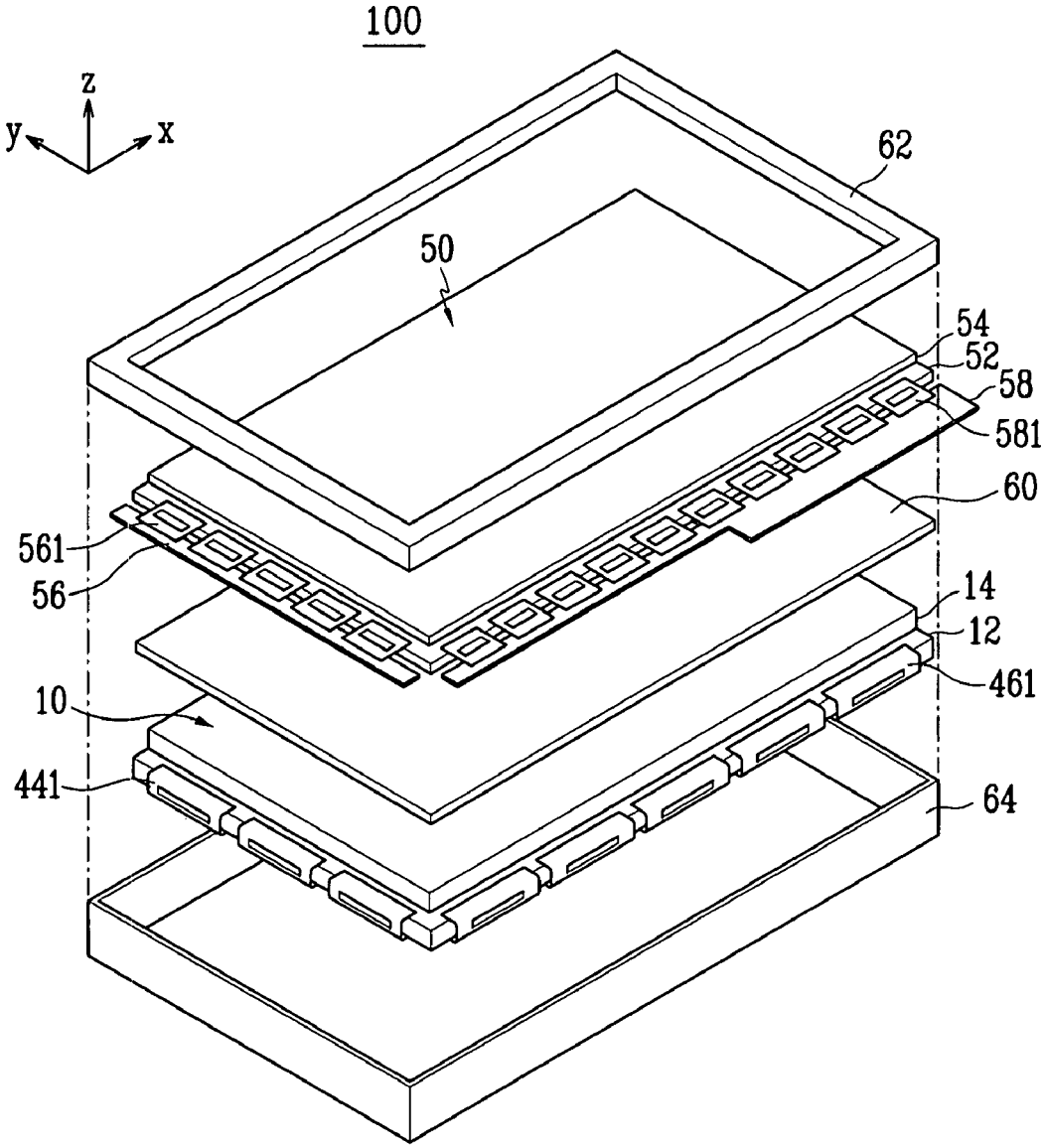
FIG. 6 is an exploded perspective view of a display device according to an embodiment of the present invention.

FIG. 6 is an exploded perspective view of a display device according to an embodiment of the present invention. The display device of FIG. 6 is exemplary only, and does not limit the present invention.

Referring to FIG. 6, a display device 100 of this embodiment includes a light emission device 10 and a display panel 50 disposed in front of the light emission device 10. A diffuser 60 for uniformly diffusing the light emitted from the light emission device 10 toward the display panel 50 may be disposed between the display panel 50 and the light emission device 10. The diffuser 60 may be spaced apart from the light emission device 10 by a predetermined distance. A top chassis 62 is disposed in front of the display panel 50 and a bottom chassis 64 is disposed at the rear of the light emission device 10.

The display panel 50 may be a liquid crystal display panel or any other non-self emissive display panel. In the following description, a liquid crystal display panel is exampled.

The display panel 50 includes a thin film transistor (TFT) substrate 52 comprised of a plurality of TFTs, a color filter substrate 54 disposed on the TFT substrate 52, and a liquid crystal layer (not shown) disposed between the TFT substrate 52 and the color filter substrate 54. Polarizer plates (not shown) are attached on a top surface of the color filter substrate 54 and a bottom surface of the TFT substrate 52 to polarize the light passing through the display panel 50.

The TFT substrate 52 is a glass substrate on which the TFTs are arranged in a matrix pattern. A data line is connected to a source terminal of one TFT and a gate line is connected to a gate terminal of the TFT. In addition, a pixel electrode is formed on a drain terminal of the TFT.

When electrical signals are input from circuit board assemblies 56 and 58 to the respective gate and data lines, electrical signals are input to the gate and source terminals of the TFT. Then, the TFT turns on or off according to the electrical signals input thereto, and outputs an electrical signal required for driving the pixel electrode to the drain terminal.

RGB color filters are formed on the color filter substrate 54 so as to emit predetermined colors as the light passes through the color filter substrate 54. A common electrode is deposited on an entire surface of the color filter substrate 54.

When electrical power is applied to the gate and source terminals of the TFTs to turn on the TFTs, an electric field is formed between the pixel electrode and the common electrode. Due to the electric field, the orientation of liquid crystal molecules of the liquid crystal layer disposed between the TFT substrate 52 and the color filter substrate 54 can be varied, and thus the light transmissivity of each pixel can be varied according to the orientation of the liquid crystal molecules.

The circuit board assemblies 56 and 58 of the display panel 50 are connected to drive IC packages 561 and 581, respectively. In order to drive the display panel 50, the gate circuit board assembly 56 transmits a gate drive signal and the data circuit board assembly 58 transmits a data drive signal.

The number of pixels of the light emission device 10 is less than that of the display panel 50 so that one pixel of the light emission device 10 corresponds to two or more pixels of the display panel 50. Each pixel of the light emission device 10 emits light in response to the highest gray value among the corresponding pixels of the display panel 50. The light emission device 10 can represent 2-8 bits gray value at each pixel.

For convenience, the pixels of the display panel 50 will be referred to as first pixels and the pixels of the light emission device 10 will be referred to as second pixels. In addition, a plurality of first pixels corresponding to one second pixel will be referred to as a first pixel group.

In order to drive the light emission device 10, a signal control unit (not shown) for controlling the display panel 50 detects a highest gray value among the first pixels of the first pixel group, calculates a gray value required for the light emission of the second pixel according to the detected gray value, converts the calculated gray value into digital data, and generates a driving signal of the light emission device 10 using the digital data. The drive signal of the light emission device 10 includes a scan drive signal and a data drive signal.

Circuit board assemblies (not shown), that is a scan circuit board assembly and a data circuit board assembly, of the light emission device 10 are connected to drive IC packages 441 and 461, respectively. In order to drive the light emission device 10, the scan circuit board assembly transmits a scan drive signal and the data circuit board assembly transmits a data drive signal. One of the first and second electrodes receives the scan drive signal and the other receives the data drive signal.

Therefore, when an image is to be displayed by the first pixel group, the corresponding second pixel of the light emission device 10 is synchronized with the first pixel group to emit light with a predetermined gray value. The light emission device 10 has pixels arranged in rows and columns. The number of pixels arranged in each row may be 2 through 99 and the number of pixels arranged in each column may be 2 through 99.

As described above, in the light emission device 10, the light emission intensities of the pixels of the light emission device 10 are independently controlled to emit a proper intensity of light to each first pixel group of the display panel 50. As a result, the display device 100 of the present invention can enhance the dynamic contrast and image quality of the screen.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A light emission device comprising:

first and second substrates facing each other and forming a space therebetween;

an electron emission unit located on the first substrate; and a light emission unit located on the second substrate, wherein the electron emission unit and the light emission unit face each other;

wherein the light emission unit includes:

a transparent anode electrode formed on the second substrate;

a phosphor layer formed on the anode electrode; and at least one sub-electrode located on the anode electrode, wherein the at least one sub-electrode has a resistance lower than that of the anode electrode, wherein the phosphor layer includes a plurality of sections spaced apart from each other, wherein the at least one sub-electrode comprises a plurality of first and second sub-electrodes, wherein the plurality of second sub-electrodes are formed between the sections of the phosphor layer, and wherein at least one second sub-electrode has a width greater than that of the first sub-electrodes.

2. The light emission device of claim 1, wherein the at least one sub-electrode is covered by or contacts the phosphor layer.

3. The light emission device of claim 1, wherein the at least one sub-electrode is formed of at least one of the following: Mo, Al, a Mo alloy, and an Al alloy.

4. The light emission device of claim 1, wherein the thickness of the at least one sub-electrode is substantially the same as that of the phosphor layer.

5. The light emission device of claim 1, wherein the at least one sub-electrode is formed of a carbon-based conductive material.

6. The light emission device of claim 1, wherein the width of the at least one sub-electrode is in the range of about 5 μm to about 20 μm.

7. The light emission device of claim 1, wherein at least one second sub-electrode is formed of a material substantially the same as that of the first sub-electrodes.

8. The light emission device of claim 1, wherein the light emission unit further includes a reflective layer formed on a surface of the phosphor layer facing the first substrate.

9. The light emission device of claim 1, wherein the light emission unit is configured to emit light to a non-self emissive display device through the second substrate.

10. A display device comprising:

a display panel for displaying an image; and a light emission device configured to provide light to the display panel, wherein the light emission device comprises:

first and second substrates facing each other and defining a space therebetween; and a light emission unit including i) a transparent anode electrode formed on the second substrate, ii) a phosphor layer formed on the anode electrode, and iii) a plurality of first sub-electrodes contacting the anode electrode, wherein at least one of the plurality of first sub-electrodes has a resistance lower than that of the anode electrode, wherein at least two of the first sub-electrodes differ in width.

11. The display device of claim 10, wherein the light emission device includes a plurality of pixels, the number of which is less than that of the pixels of the display panel, arranged in first and second directions substantially crossing each other.

12. The display device of claim 11, further comprising an electron emission unit located on the first substrate and including a plurality of scan electrodes arranged along one of the first and second directions and a plurality of data electrodes arranged along the other direction.

13. The display device of claim 12, wherein the pixels of the light emission device have light intensities controlled by the scan and data electrodes.

14. The display device of claim 10, wherein the thickness of at least one of the plurality of first sub-electrodes is less than that of the phosphor layer, and the phosphor layer covers the at least one first sub-electrode.

15. The display device of claim 10, wherein the first sub-electrodes is covered by or contacts the phosphor layer.

16. The display device of claim 10, wherein the light emission unit further includes a reflective layer formed on a surface of the phosphor layer facing the first substrate.

17. A display device comprising:

a display panel for displaying an image; and a light emission device configured to provide light to the display panel, wherein the light emission device comprises:

first and second substrates facing each other and defining a space therebetween; and a light emission unit including i) a transparent anode electrode formed on the second substrate, ii) a phosphor layer formed on the anode electrode, and iii) a plurality of first sub-electrodes contacting the anode electrode, wherein at least one of the plurality of first sub-electrodes has a resistance lower than that of the anode electrode, wherein the phosphor layer includes a plurality of sections spaced apart from each other, wherein the light emission device further comprises a plurality of second sub-electrodes formed between the sections of the phosphor layer, and wherein at least one of the plurality of second sub-electrodes has a width greater than that of the first sub-electrodes.

* * * * *